US010285524B2

(12) United States Patent
Merandi

(10) Patent No.: US 10,285,524 B2
(45) Date of Patent: May 14, 2019

(54) GARMENT HANGER

(71) Applicant: John Michael Merandi, Alvin, TX (US)

(72) Inventor: John Michael Merandi, Alvin, TX (US)

( * ) Notice: Subject to any disclaimer, the term of this patent is extended or adjusted under 35 U.S.C. 154(b) by 0 days.

(21) Appl. No.: 15/211,719

(22) Filed: Jul. 15, 2016

(65) Prior Publication Data

US 2017/0065112 A1 Mar. 9, 2017

Related U.S. Application Data

(63) Continuation of application No. 14/070,464, filed on Nov. 1, 2013, now Pat. No. 9,414,702, which is a continuation-in-part of application No. 13/356,435, filed on Jan. 23, 2012, now abandoned.

(60) Provisional application No. 61/435,156, filed on Jan. 21, 2011, provisional application No. 61/721,360, filed on Nov. 1, 2012.

(51) Int. Cl.

| | |
|---|---|
| ***A47G 25/32*** | (2006.01) |
| ***A47F 7/19*** | (2006.01) |
| ***A47G 25/40*** | (2006.01) |

(52) U.S. Cl.

CPC ..... *A47G 25/32* (2013.01); *A47F 7/19* (2013.01); *A47G 25/4015* (2013.01); *Y10T 29/49826* (2015.01)

(58) Field of Classification Search

CPC ..... A46G 25/4023; A46G 25/4105; A46G 25/32; A46G 25/1407; A46G 25/1428; A46G 25/22; A46G 25/0607; A46G 25/0605; A47F 7/19; Y10T 29/49826

See application file for complete search history.

(56) References Cited

U.S. PATENT DOCUMENTS

| | | | | | |
|---|---|---|---|---|---|
| 768,446 | A * | 8/1904 | Gager | A47G 25/4023 | 223/94 |
| 2,908,428 | A * | 10/1959 | Schrunk | A47G 25/32 | 223/88 |
| 4,168,791 | A * | 9/1979 | Clark, Jr. | A47G 25/50 | 223/94 |
| 4,624,396 | A * | 11/1986 | Universe | A47G 25/1407 | 206/281 |
| 4,717,053 | A * | 1/1988 | Wang | A47G 25/4053 | 211/118 |
| 5,082,152 | A * | 1/1992 | Chen | A47G 25/442 | 211/117 |
| 5,085,357 | A * | 2/1992 | Chen | A47G 25/4038 | 223/85 |
| 8,113,393 | B2 * | 2/2012 | Ho | A47G 25/32 | 223/85 |
| 9,414,702 | B2 * | 8/2016 | Merandi | A47G 25/4015 | |
| 9,492,025 | B1 * | 11/2016 | Wu | A47G 25/18 | |

(Continued)

*Primary Examiner* — Ismael Izaguirre

(57) ABSTRACT

A garment hanger includes a garment support structure having first and second arms arranged for supporting the opposed shoulders of a garment. The two arms are rigid and in a fixed relation to each other. A hook unit is included and configured for suspending the hanger from a support structure, and a means or structure is provided for coupling the hook unit to the garment support structure enabling both the first and second arms to rotate in substantially a same plane about a generally horizontal pivot axis.

18 Claims, 13 Drawing Sheets

(56) References Cited

U.S. PATENT DOCUMENTS

2016/0088965 A1* 3/2016 Hansen ..... A47G 25/32
223/85

* cited by examiner

GARMENT HANGER

CROSS-REFERENCE TO RELATED APPLICATION

This application is a continuation of prior pending U.S. patent application Ser. No. 14/070,464, filed Nov. 1, 2013 which is a continuation-in-part of prior pending U.S. patent application Ser. No. 13/356,435, filed Jan. 23, 2012, which application claims priority under 35 USC 119(e) to U.S. provisional Application Ser. No. 61/435,156, filed on Jan. 21, 2011. U.S. patent application Ser. No. 14/070,464 also claims priority under 35 U.S.C. 119(e) to U.S. provisional Application Ser. No. 61/721,360, filed on Nov. 1, 2012. Each of these applications is incorporated herein by reference.

TECHNICAL FIELD

The present disclosure relates generally to garment hangers, and more particularly, to a garment hanger having arms that pivot about a pivot axis point on the hanger hook/neck.

BACKGROUND

Most common garment (or clothes) hangers are constructed of plastic material. The plastic material, as well as the process for manufacturing, is relatively inexpensive. However, the arms and hook/neck are rigid and usually rigidly affixed together. Other hangers are generally more expensive because of the material (e.g., wood, metal, etc.) used or because they include additional functionality (e.g., folding, foldable arms, use for special garments, collapsible, etc.).

The common relatively inexpensive plastic hanger has at least one drawback—when a user pulls a garment from the hanger, the hanger can break. This is especially problematic for smaller hangers used mainly for children's garments, as they tend to be smaller and more prone to breaking. In addition, due to their height size and lack of experience with hangers, children and toddlers often pull downward (from below) on the garment while the hanger remains on the rod while attempting to remove the garment. Many times, due to the rigidity of the arms, as the garment is pulled (usually at one side) downward one arm of the hanger rotates downward and the other arm rotates upward. At the same time, the garment usually gets caught to the smaller neck area and the child tends to pull harder on garment. As a result of this force, the hanger arm(s) or neck may break.

In addition, because common plastic hangers are manufactured as a single integral unit, shipping and packaging containers need to conform or address the full size of the hanger.

Accordingly, there is needed a relatively inexpensive (material and manufacture) garment hanger that resists such forces, reduces the likelihood of breakage, and can be packaged economically and within a smaller volume.

SUMMARY

According to an embodiment of the disclosure, there is provided a garment hanger including a garment support structure having first and second elongated arms arranged for supporting the opposed shoulders of a garment. The first and second arms are configured in a rigid and fixed relation to each other, and each of the first and second elongated arms having an outer end spaced apart relative to one another. The hanger includes a hook member configured for suspending the hanger from a support structure. The hanger further includes a structure for coupling the hook member to the garment support structure and for enabling both the first and second arms to rotate in substantially a same plane about a generally horizontal pivot axis.

The foregoing has outlined rather broadly the features and technical advantages of the present disclosure so that those skilled in the art may better understand the detailed description that follows. Additional features and advantages of the present disclosure will be described hereinafter that form the subject of the claims. Those skilled in the art should appreciate that they may readily use the concept and the specific embodiment(s) disclosed as a basis for modifying or designing other structures for carrying out the same or similar purposes of the present disclosure. Those skilled in the art should also realize that such equivalent constructions do not depart from the spirit and scope of the claimed invention in its broadest form.

Before undertaking the Detailed Description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior uses, as well as future uses, of such defined words and phrases.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 2:
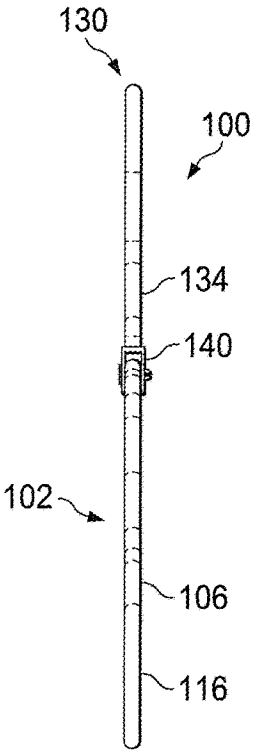
FIGS. 1 and 2 illustrate front and side views of a garment hanger in accordance with one embodiment of the disclosure.

FIGS. 1-19 and the various embodiments used to describe the principles of the present disclosure in this patent document are by way of illustration only and should not be construed in any way to limit its scope. Those skilled in the art will understand that the principles described herein may be implemented with any type of suitably arranged device and/or devices.

To simplify the drawings, reference numerals from previous drawings may sometimes not be repeated for structures that have already been identified.

Figure 1:
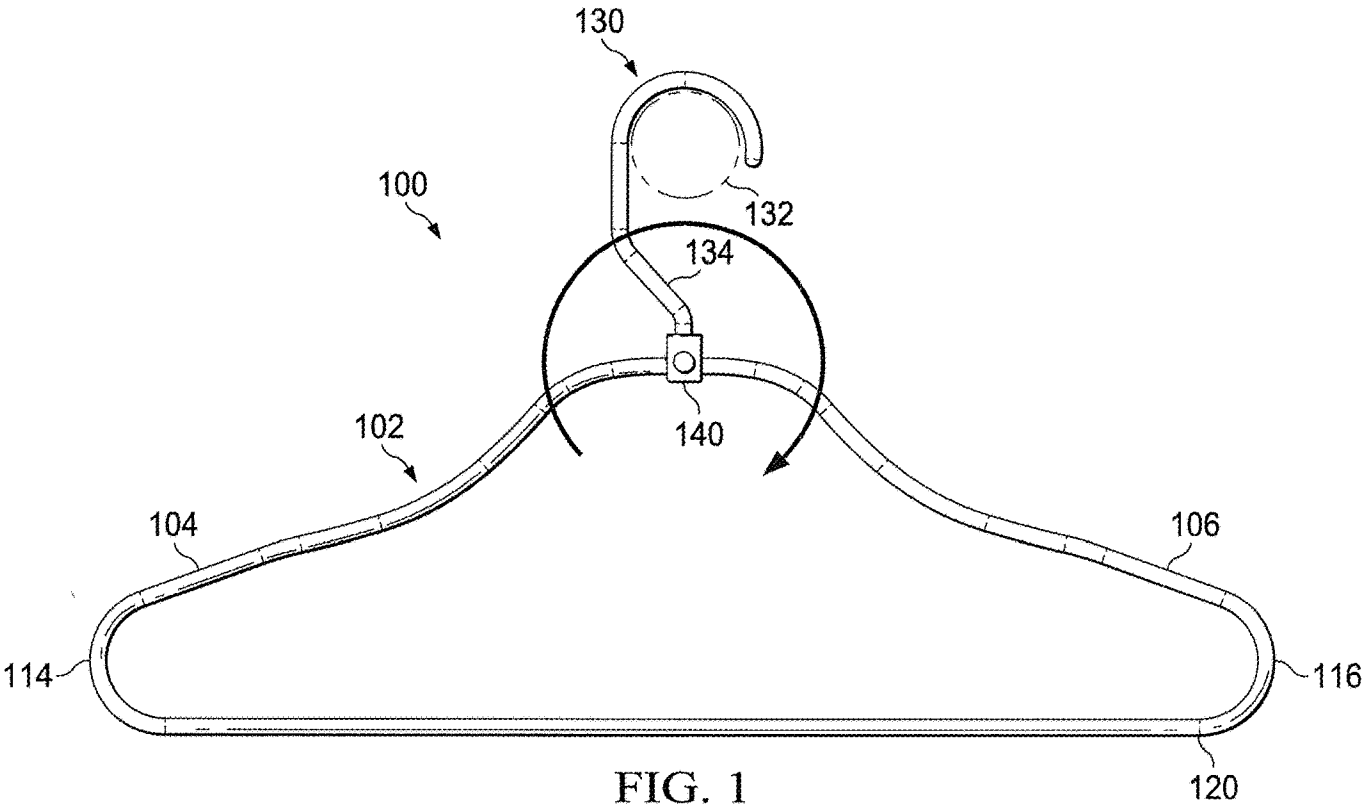
Figure 3:
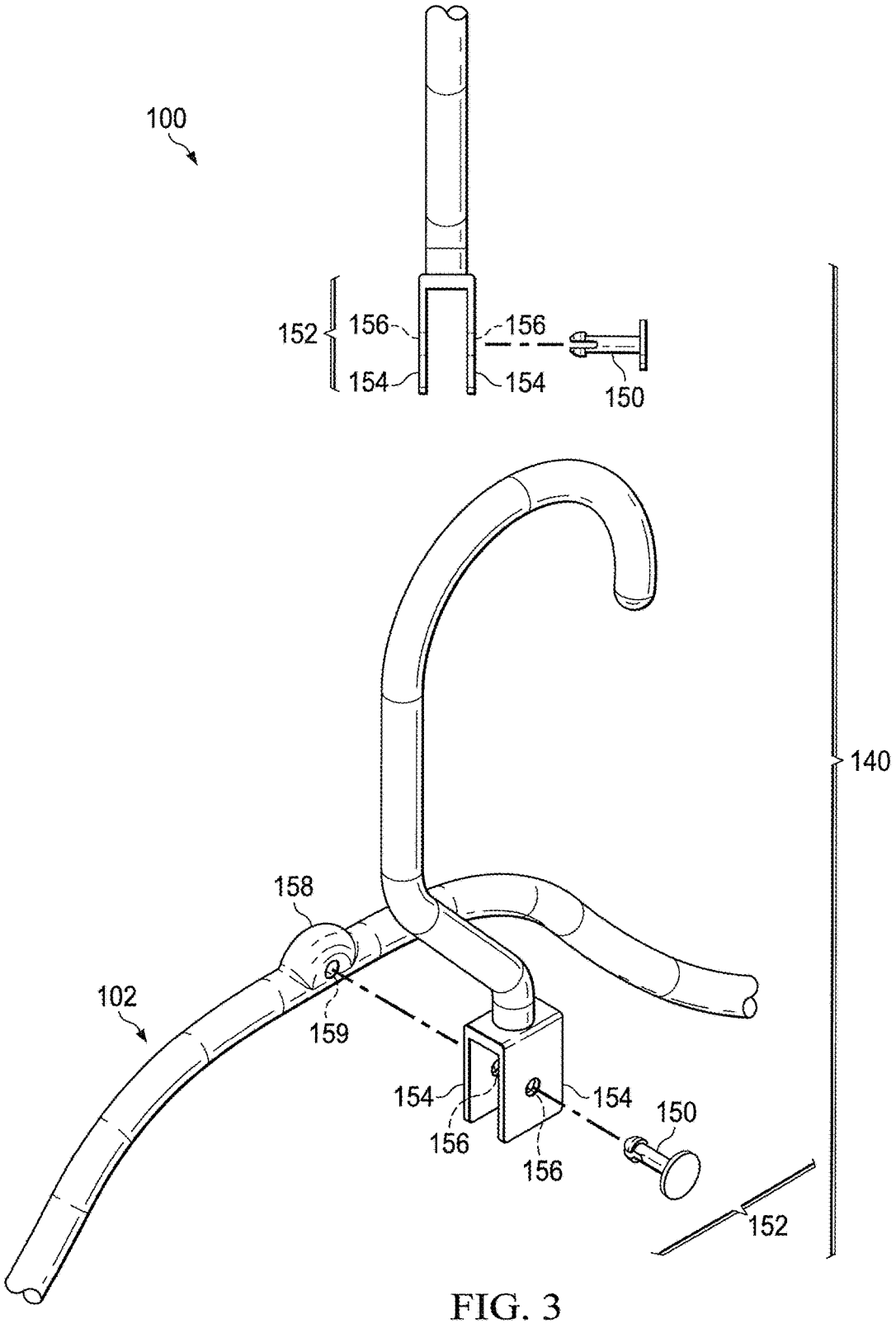
FIG. 3 illustrates a more detailed and exploded view of one embodiment of a coupling means shown in FIGS. 1 and 2.

Referring to FIGS. 1 and 2, there are shown a front view and a side view, respectively, of a garment hanger 100 in accordance with one embodiment of the present disclosure. The hanger 100 includes a garment support structure 102 having two elongated arms 104, 106. Each of the arms 104, 106 are adapted for supporting a different shoulder of a garment (e.g., shirt, T-shirt, dress, sweater, and the like). In one embodiment, the arms 104, 106 are about equal in length to each other in the hanger 100, though they may be of different lengths.

Each of the arms 104, 106 includes an outer end 114, 116, respectively. In the embodiment illustrated, each of the arms 104, 106 extends generally downwardly relative to the other arm, and the outer ends 114, 116 are interconnected to by an elongated lower cross member 120. Such interconnections are, preferably, integrally formed and curved in order to avoid catching or snagging any portion of a garment. In another embodiment (not shown), the cross member 120 may be omitted.

The arm 104 and the arm 106 of the garment support structure 102 are structured or configured to be in a fixed relation with respect to each other. In other words, not only are the arms 104, 106 in a fixed relation, the outer end 114 and the outer end 116 are also in a fixed relation to each other. In other words, the arms 104 and 106 are adapted or structured such that they do not fold or move relative to each other. This may be accomplished by constructing the garment support structure 102 of a single unitary piece of material (e.g., plastic, wood, metal) or rigidly attaching or securing multiple structures together.

The hanger 100 includes a hook 130 for supporting the hanger 100 from a closet rod 132 or other similar structure (shown in dashed outline in FIG. 1). The hanger 100 further includes a hanger neck 134 coupled to the hook 130. The neck 134 is generally a smoothly arcuate structure which terminates at a coupling end 140. A coupling means 140 provides a coupling mechanism (or function) that allows or enables the garment support structure 102 to pivot in relation to the hook 130 (and neck 134) and about a pivot axis 150. The pivot axis 150 extends in the horizontal direction (into and out of the drawing page in FIG. 1) as shown in FIG. 2. Thus, the two arms 104, 106 rotate in a circular direction about the pivot axis 150. As will be understood, the extent of rotation will generally be limited by the dimensions and configuration of the arms 104, 106 and the hook 130/neck 134.

As will be described in more detail set forth below, the coupling means 140 may include a portion of the hook 130/neck 134, a portion of the garment support structure, one or more additional structures, or a combination of any of these.

In the embodiment illustrated in FIG. 1 (and illustrated in more detail in FIG. 3), the coupling means 140 includes a pivot pin 150 that secures an end portion 152 of the hook 130/neck 134 to the garment support structure 102. The end portion 152 (e.g., female portion) has a shape similar to a fork, and includes two spaced apart downwardly extending portions 154, with each portion 154 including an aperture 156 (for receiving the pivot pin 150). A portion 158 (e.g. male portion) of the garment support structure 102 also includes an aperture 159 (for receiving the pivot pin 150). In this embodiment, the pivot pin 150 may have a structure similar to a rivet, axle, kotter pin or the like.

In this particular embodiment, the coupling mechanism includes at least the pivot pin 150, and may further be considered to include the two spaced apart downwardly extending portions 154 and the portion 158 of the structure 102. Various other coupling mechanisms 140 may be utilized as desired, so long as each provides the desired function of allowing the ends 104, 106 to rotate relative to the hook 130/neck 134 and about an axis point. It will be understood that persons of ordinary skill in the art can readily identify coupling mechanism 140 that may be utilized.

Figure 4A:
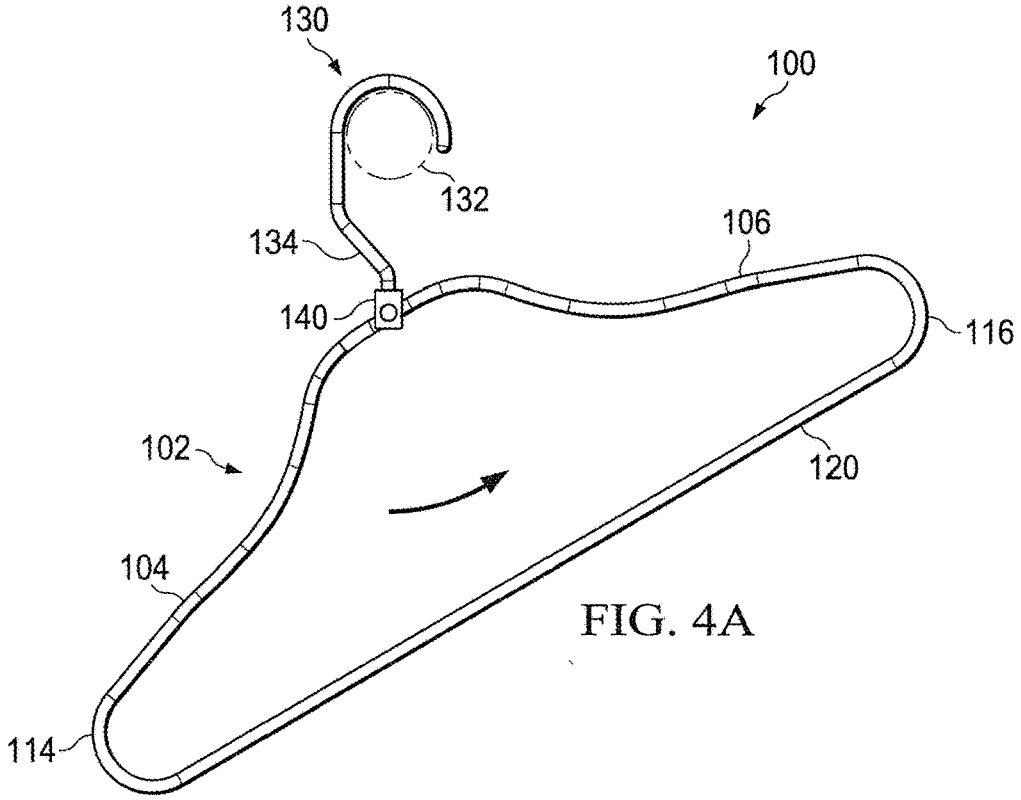
FIGS. 4A and 4B illustrate two different positions of the hanger arms as they are rotated counterclockwise and clockwise, respectively.
Figure 4B:
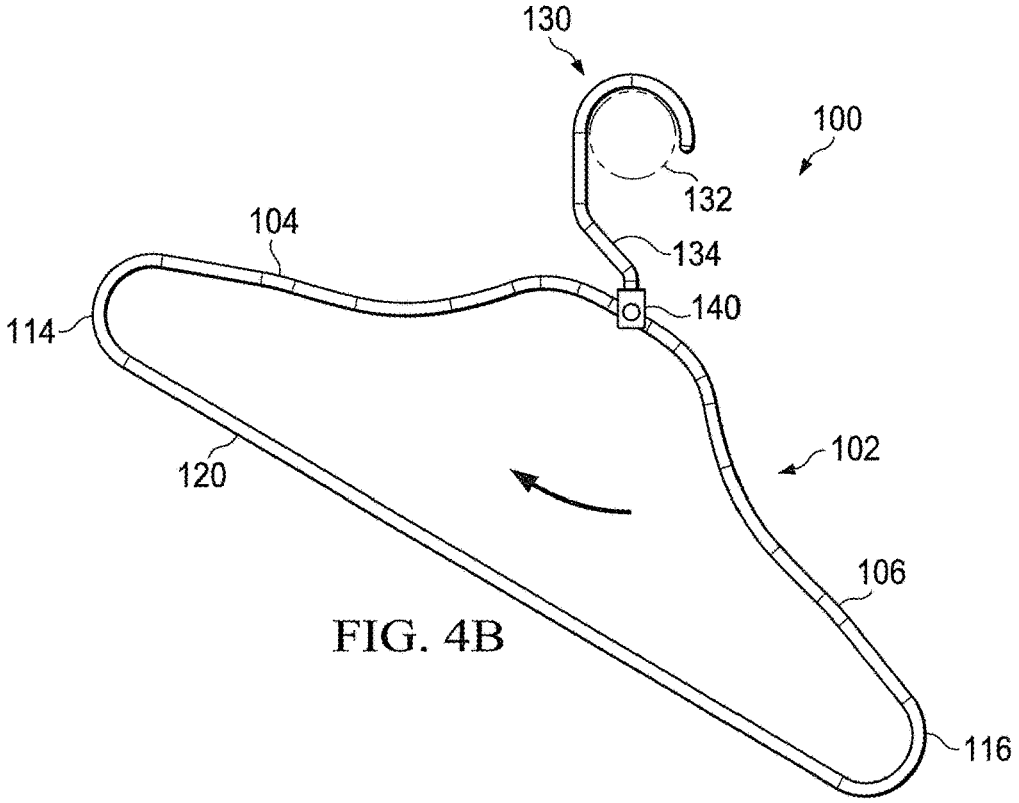

Now turning to FIGS. 4A and 4B, there are shown front views illustrating rotational movement of the ends 104, 106 of garment support structure 102 of the hanger 100 of FIG. 1.

Figure 5:
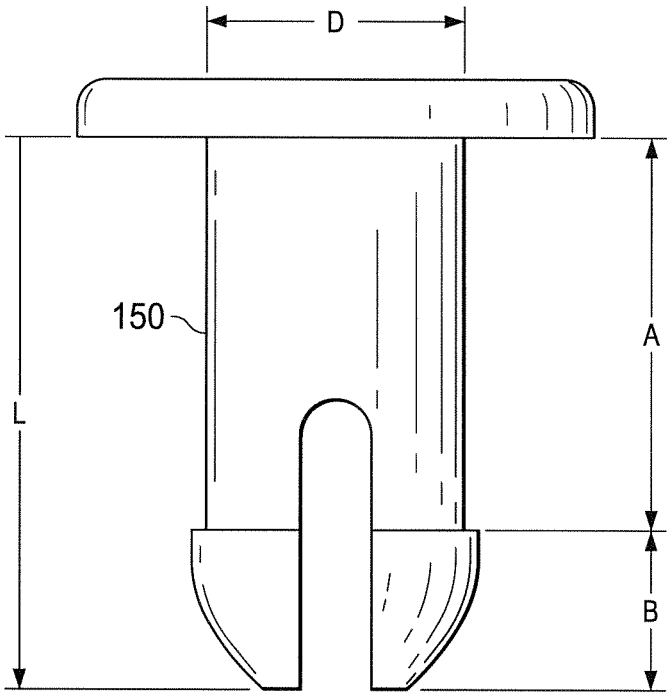
FIG. 5 illustrates one example of a pivot pin for coupling hanger arms to the hook/neck member.

In one embodiment shown in FIG. 5, the pivot pin 150 may be a push-in pin or fastener, in which the pin 150 is squeezed for insertion through the apertures 156 and aperture 159, and once inserted, the pin 150 expands to lock into place. This type of pin may be constructed of any suitable material, such as plastic (e.g., nylon). Advantages of using this type of coupling mechanism include smaller packaging and shipping convenience, since the garment support structure 102 and the hook 130/neck 134 structure can be packaged, shipped and/or purchased separately from each other. Using this type of pin or fastener, a user can easily assemble the two main hanger portions (102 and 130/134) into a fully assembled garment hanger 100.

Figure 6:
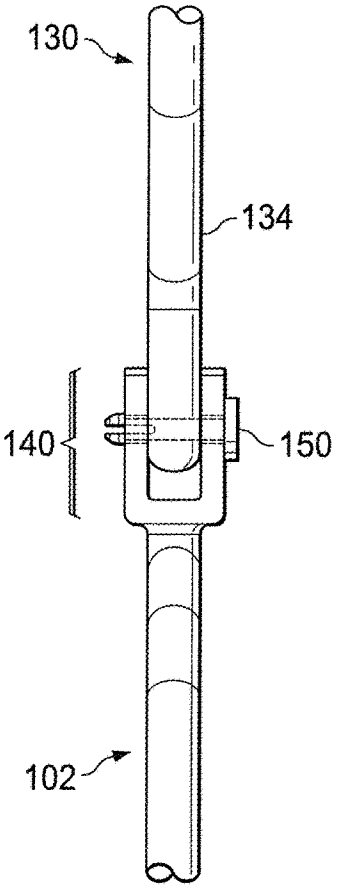

Another embodiment of the coupling mechanism 140 is shown in FIG. 6. This is similar to the embodiment shown in FIG. 3, except the male/female portions are reversed—as shown.

Figure 7:
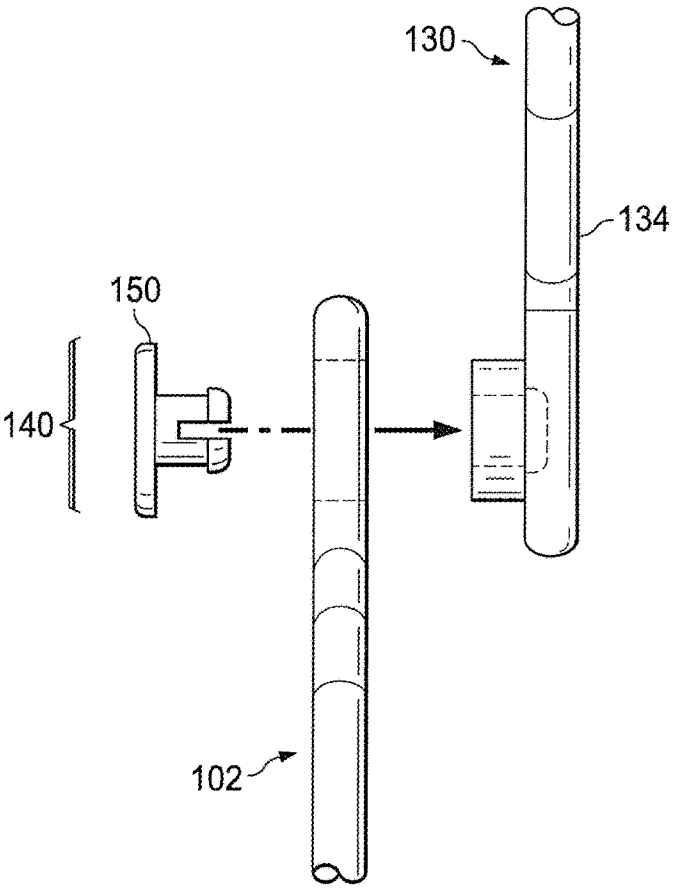

Turning to FIG. 7, there is shown an alternative embodiment of the coupling mechanism 140. The forked configuration has been deleted and the two portions 102 and 130/134 are simply positioned adjacent to one another and interconnected about the pivot point, as shown. This may be accomplished using the pivot pin 150, or some similar structure such as a snap pin or rivet. The ends of the hook member/neck 130/134 and the support structure 102 may be suitably structured or configured to enable a rotational pivot point, as described earlier. In this embodiment, the 102 structure is considered as the "female" portion. As will be appreciated, and though not shown, the embodiment in FIG. 7 may be reversed, such that the structure 102 may be alternatively configured to be considered as the "male" portion.

Figure 8:
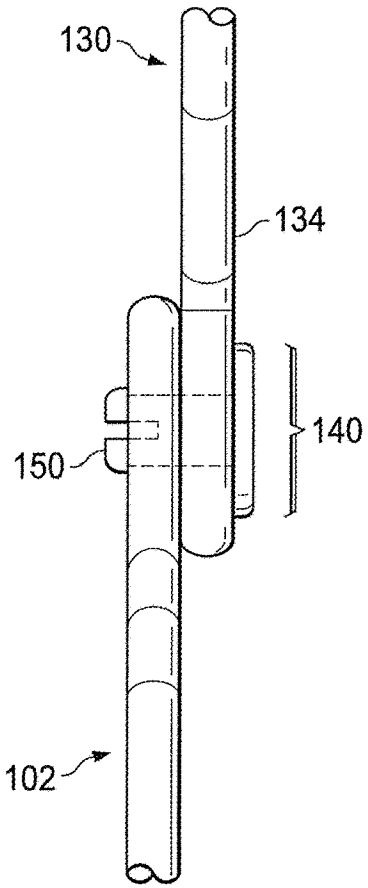
FIGS. 6-12 illustrate different embodiments of the coupling mechanism.

Now turning to FIG. 8, there is shown is shown another embodiment of the coupling mechanism 140. Instead of having differently configured ends (i.e., male and female), each of the end portions have an aperture and a pivot pin (snap pin or rivet, etc.) is disposed therebetween to connect them.

Figure 9:
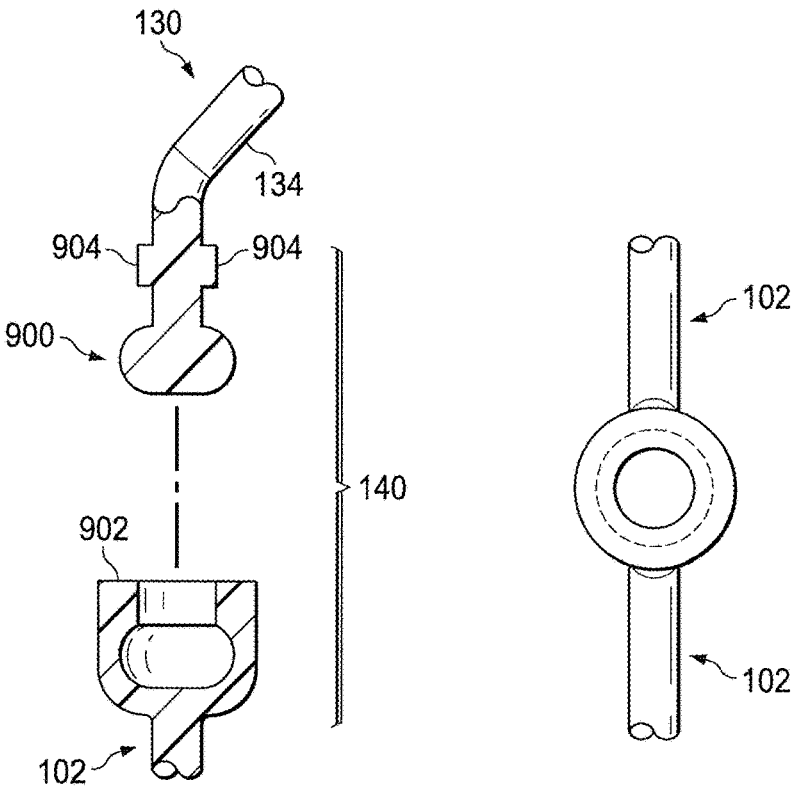

Now turning to FIG. 9, there is illustrated another embodiment of the coupling mechanism 140. The portion 130/134 includes a ball-shaped portion 900 while the structure 102 is structured with a receiving portion 902 having an opening therein for receiving the portion 900. The dimensions of the structures are sized to allow the portion 902 to "snap" into the opening of the portion 902. One connected, the amount of force necessary to remove the portion 900 is substantial. In addition, and though not shown, the end receiving portion 902 may be configured or structured to deform or allow relatively easy insertion of the ball-shaped portion 900 into the receiving portion 902. Shapes other than the shape of a round ball may be utilized, as appropriate. In addition, once inserted, the structure 102 may pivot (rotate and twist) about a pivot point in all directions. This may be beneficial in some applications. In another embodiment, as shown in FIG. 9, the coupling mechanism includes members 904 that restrict movement of the structure 102 relative to the hook/neck 130/134. In one embodiment, the structure 102 is prevented from rotating about the hook/neck 130/134. In another embodiment, the structure is restricted such that it is only allowed to move about the pivot axis in a single plane—that plane being illustrated in FIGS. 4A and 4B. Different structure(s) or member(s) may be utilized as part of the structure 102, the hook/neck 130/134 or both, to provide this functionality.

Figure 10:
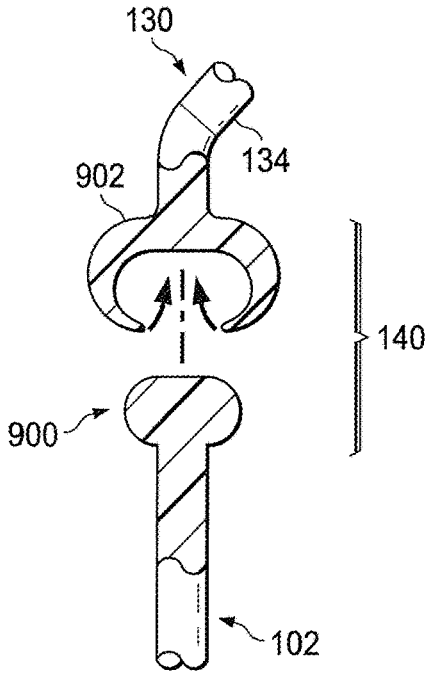

Now turning to FIG. 10, this embodiment is similar to the one described in FIG. 9, however the structure 120 includes the ball-shaped portion 900 (or similar structure) and the hook/neck 130/134 includes the receiving portion 902. This embodiment may also include other structures or members such as 904, etc. to restrict movement as described above.

Figure 11:
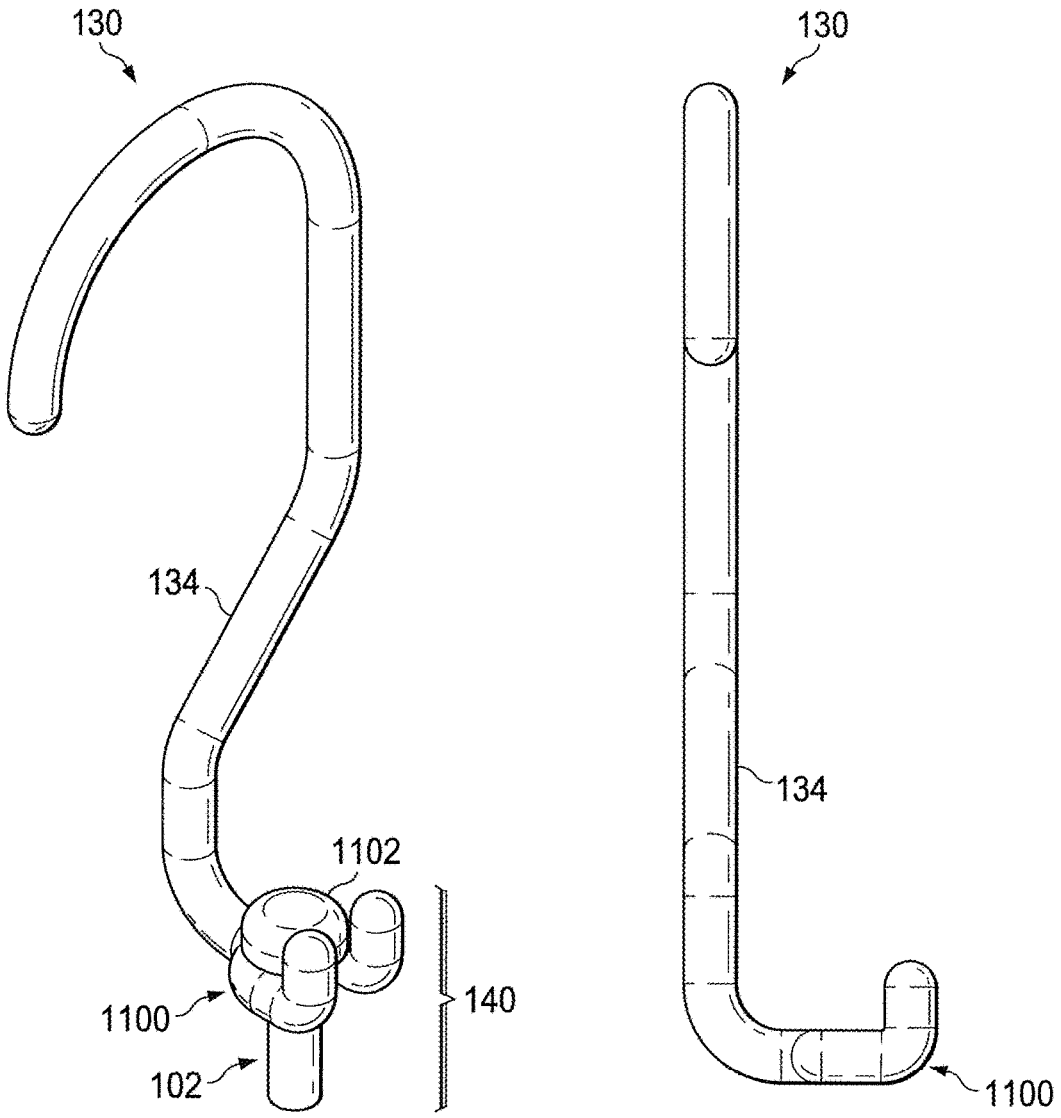

Now turning to FIG. 11, there is illustrated another embodiment (two views) of the coupling mechanism 140. The portion 130/134 includes a receiving portion 1100 which receives a ball-shaped portion 1102. The receiving portion 1110 is hook-shaped, as illustrated, and includes two prongs or forks (as shown). The dimensions of the structures are sized to allow the portion 1102 to rest within the "hook" of the portion 1102. Shapes other than the shape of a round ball may be utilized, as appropriate. In addition, once inserted, the structure 102 might pivot (rotate and twist) about a pivot point in all directions. This may be beneficial in some applications. In another embodiment, the coupling mechanism includes additional structures or members 904 (not shown) that will restrict movement of the structure 102 relative to the hook/neck 130/134. In one embodiment, the structure 102 will only be allowed to move about the pivot axis in a single plane—that plane being illustrated in FIGS. 4A and 4B. Different structure(s) or member(s) may be utilized as part of the structure 102, the hook/neck 130/134 or both, to provide this functionality.

Figure 12:
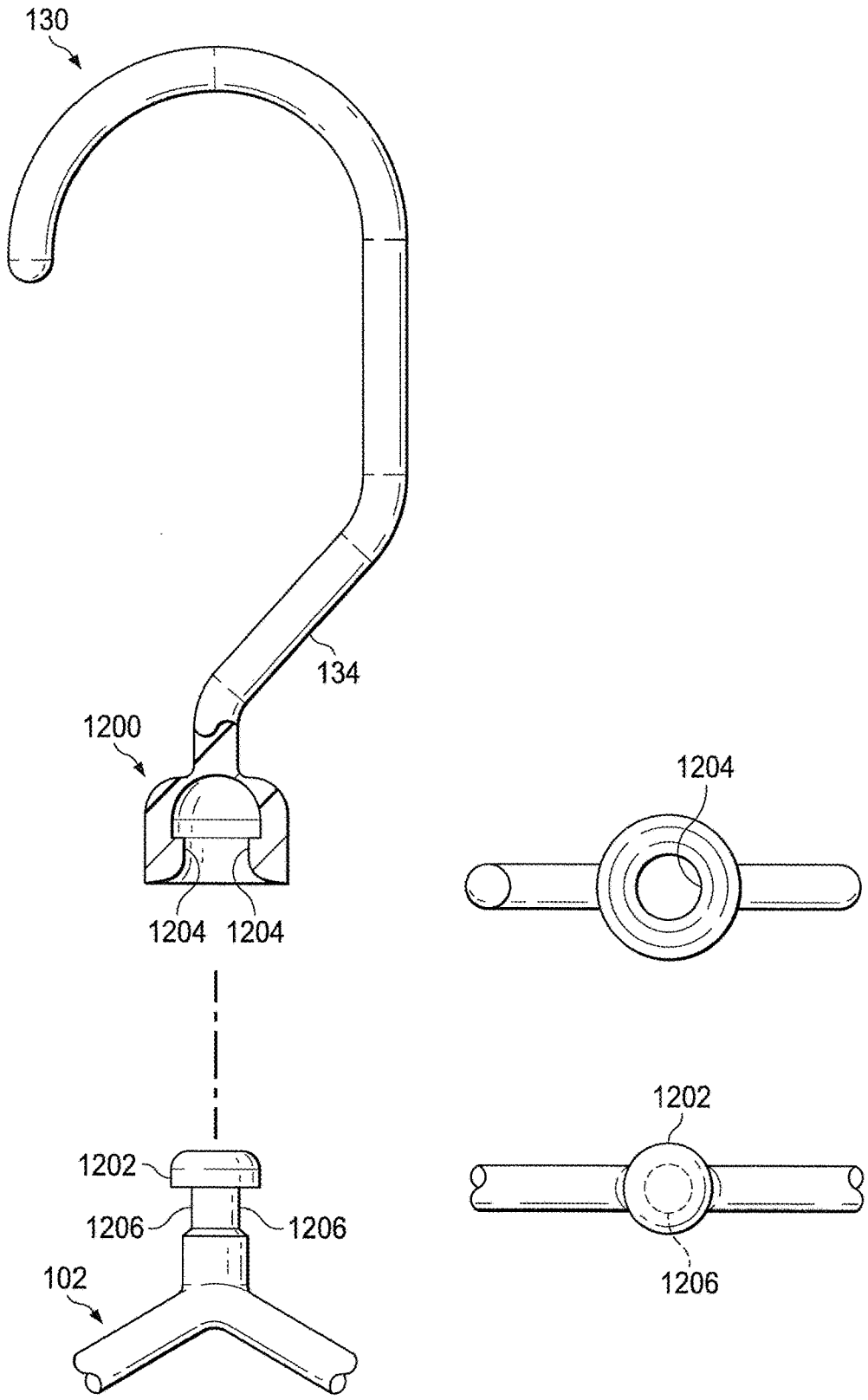

Now turning to FIG. 12, there is illustrated another embodiment (two figures) of the coupling mechanism 140. The portion 130/134 includes a receiving portion 1200 which receives a pin-shaped portion 1202. The receiving portion 1200 includes two downwardly extending portions with inner surfaces. The inner surfaces include protrusions or ridges 1204 for contacting or mating with corresponding indentations or valleys 1206 in the pin-shaped portion 1202 of the structure 102. The protrusions 1204 and indentations 1206 will be configured to "snap" together when the two portions are aligned and pushed together. Once snapped in place, a substantial force may be required for removal. Thus, the receiving portion 1200 will beneficially be configured or structured to deform to some degree with force is applied for insertion of the pin-shaped portion 1202. Once inserted, removal will likely require a substantial amount of additional force. The shape of the protrusions 1204 and the indentions 1206 (and the portions 1200, 1202) will restrict movement of the structure 102 relative to the hook/neck 130/134. In one embodiment, the structure 102 will only be allowed to move about the pivot point (becoming a pivot axis) in a single plane—that plane being illustrated in FIGS. 4A and 4B. Different structure(s) or member(s) may be utilized as part of the structure 102, the hook/neck 130/134 or both, to provide this functionality.

As will be appreciated with respect to the embodiment in FIG. 12, the protrusions 1204 and indentations 1206 may be switched—that is, the portion 1200 may include the indentions 1206 while the portion 1202 may include the protrusions 1204. Similarly, the female/male configuration may be switched—that is, the portion 1200 may be the "male" (having the pin-shape) and the portion 1202 may be the "female" (having the receiving portion).

In any of the foregoing embodiments, it may be desirable for the structure 102 (with the arms 104, 106) to be relatively stationary under ambient conditions. That is, at rest (without any force), the hanger 100 will be in the ambient condition as shown in FIG. 1. To prevent any unwanted pivoting movement due to a relative light force applied (i.e., moving the hanger with or without a garment, or a steady state with a garment), the surface(s) of the coupling mechanism 140 may include a coating or material that causes a low amount of friction which results in the structure 102 not pivoting under normal conditions (no substantial force applied to a garment thereon or to the structure 102). In addition, the dimensions of the members in the coupling mechanism 140 may be selected such that a low amount of friction is present under normal conditions.

The hanger 100 is typically, formed of a rod-shaped material but is not limited thereto. In one embodiment, the two hanger portions are formed of any suitable material known to those skilled in the art, and the same material or different material may be used for the two hanger portions. In one embodiment, the material is plastic material.

Figure 13:
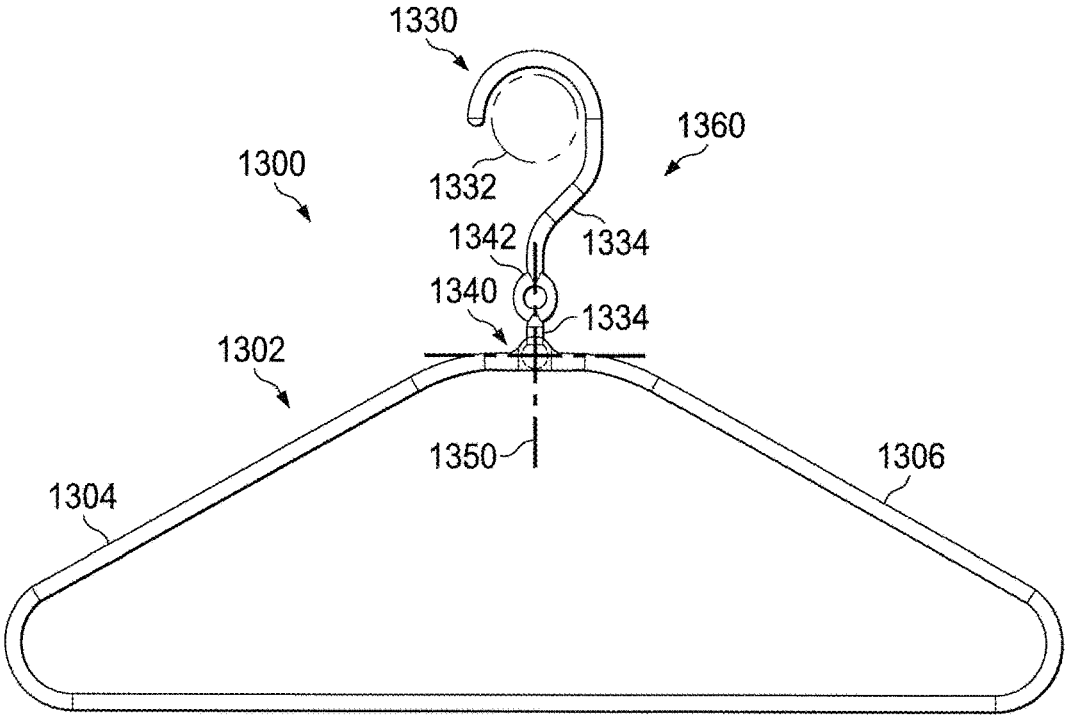
FIG. 13 illustrates a front view of another garment hanger in accordance with the present disclosure.

Now turning to FIG. 13, there is shown a front view of another garment hanger 1300 in accordance with one embodiment of the present disclosure. Similar to previous embodiments, the hanger 1300 includes a garment support structure 1302 having two elongated arms 1304, 1306. Each of the arms 1304, 1306 are adapted for supporting a different shoulder of a garment (e.g., shirt, T-shirt, dress, sweater, and the like). In one embodiment, the arms 1304, 1306 are about equal in length to each other in the hanger 1300, though they may be of different lengths.

The hanger 1300 includes a hook unit 1360 for supporting the hanger 1300 from a closet rod 1332 or other similar structure. The hook unit 1360 includes a hook portion 1330 at one end (e.g., distal end), a neck portion 1334 coupled to the hook portion 1330, and a flanged portion 1354 at the other end (e.g., proximate end). The neck 1334 is generally a smoothly arcuate structure which terminates at a coupling end 1340. The neck 1334 may also include an accessory aperture or eyelet 1342 (hereinafter referred to as eyelet 1342) configured on the hook unit 1360 to be discussed further herein. Similar to previous embodiments, a coupling means 1340 provides a coupling mechanism (or function) that allows or enables the garment support structure 1302 to pivot in relation to the hook unit 1360 about a pivot axis 1350. The pivot axis 1350 extends in the horizontal direction into and out of the drawing page in FIG. 13. Thus, the two arms 1304, 1306 rotate in a circular direction about the pivot axis 1350. As will be understood, the extent of rotation will generally be limited by the dimensions and configuration of the arms 1304, 1306, the eyelet 1342 and/or the hook 1330/neck 1334.

Figure 14:
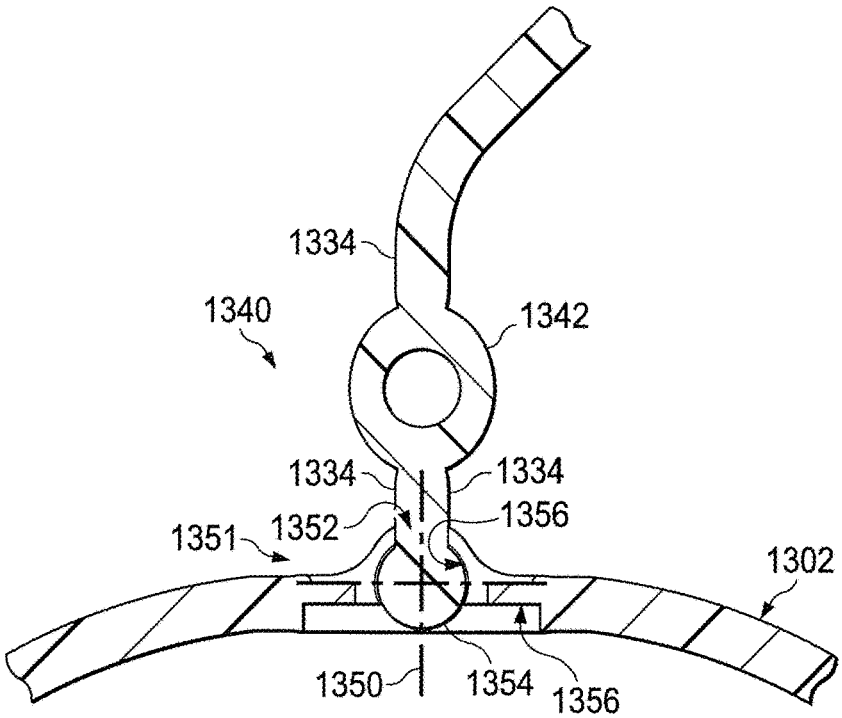
FIG. 14 is a detailed view illustrating a close-up view of a coupling mechanism shown in FIG. 13.

Turning to FIG. 14, there is illustrated a more detailed diagram of an embodiment of the coupling mechanism 1340. The coupling mechanism 1340 is configured to couple the hook unit 1360 and the garment support structure 1302 via the flanged portion 1354 and a corresponding aperture housing 1351 (formed on the garment support structure 1302). The aperture housing 1351 is integrated with the garment support structure 1302 and faces in a generally vertical direction. In one embodiment, the generally vertical direction comprises the direction from the bottom of the page to the top of page of FIG. 14 or vice versa.

The aperture housing 1351 is configured with an aperture 1352 therethrough and is also configured with a cavity or trough in an engaging portion 1356 to receive therein at least a portion of the flanged portion 1354 of the hook unit 1360. In an embodiment, when the flanged portion 1354 and the engaging portion 1356 engage, the surfaces of at least one of the flanged portion 1354 or the engaging portion 1356 are such as to allow the garment support structure to pivot about an axis, as previously discussed.

The aperture 1352 is configured to permit all of the hook unit 1360 (including the hook portion 1330, the neck 1334 and eyelet 1342) except the flanged portion 1354 to pass therethrough. In other words, the hook unit 1360 and garment structure 1302 are separate components and are assembled and combined to form the garment hanger 1300. This is accomplished by inserting the top end (distal end of the hook unit 1360) of the hook portion 1330 up through the aperture 1352 from the bottom until the flanged portion 1354 seats within the cavity/trough of the aperture housing 1351 of the garment structure 1302.

Figure 15:
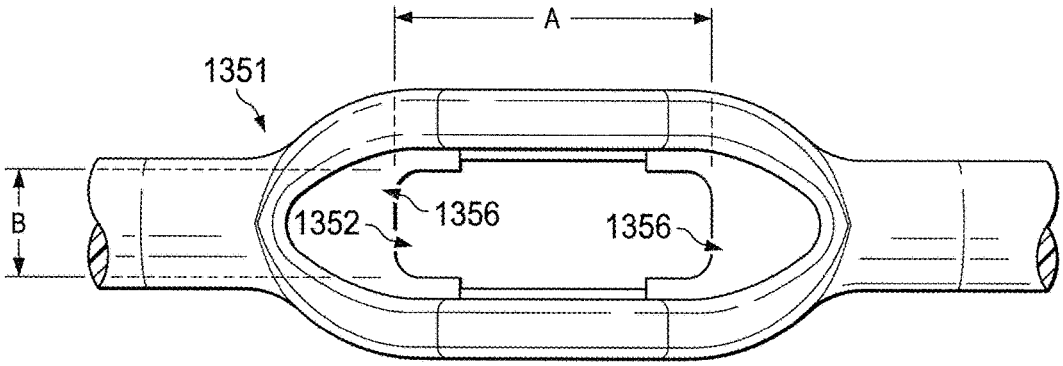
FIGS. 15 and 16 illustrate a tope view and a bottom view, respectively, of an aperture of the garment hanger shown in FIG. 14.
Figure 16:
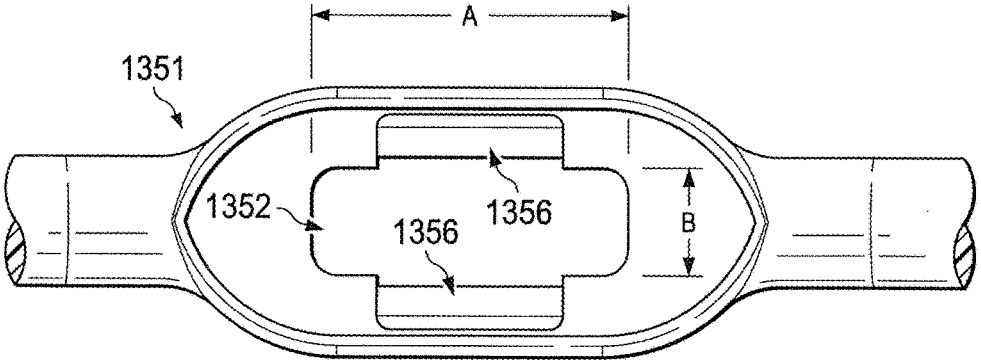

Turning to FIGS. 15 and 16, there are illustrated a more detailed top view and bottom view, respectively, of the aperture housing 1351 having the aperture 1352 formed therethrough. As will be appreciated, the dimensions of the aperture 1352 are such that the size and shape of the hook portion 1330, the neck portion 1334 and the eyelet 1342 may fit therethrough. In one embodiment, the aperture housing 1351 is configured with the shape and dimensions shown in FIGS. 15 and 16.

The aperture 1352 includes at least a first dimension "A" and a second dimension "B". The first dimension "A" is large enough so that substantially all of the hook unit 1360 (e.g., the hook portion 1330, the neck 1334 and the eyelet 1342) will fit therethrough. The second dimension "B" is also large enough so that substantially all of the hook unit 1360 (e.g., the hook portion 1330, the neck 1334 and the eyelet 1342) will fit therethrough. It will be understood that, in the configuration shown, the first dimension "A" is greater than the width (dimension "C") of the eyelet 1342, while the second dimension "B" is greater than the greatest thickness of the hook unit 1360 (dimension "D").

Figure 17:
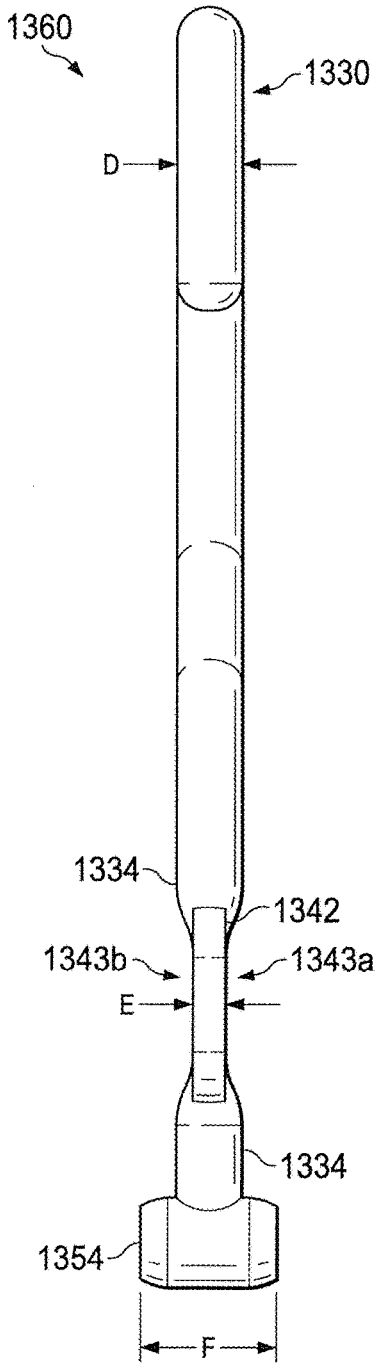
FIGS. 17 and 18 illustrate front and side views of hook unit of the garment hanger shown in FIGS. 13 and 14.
Figure 18:
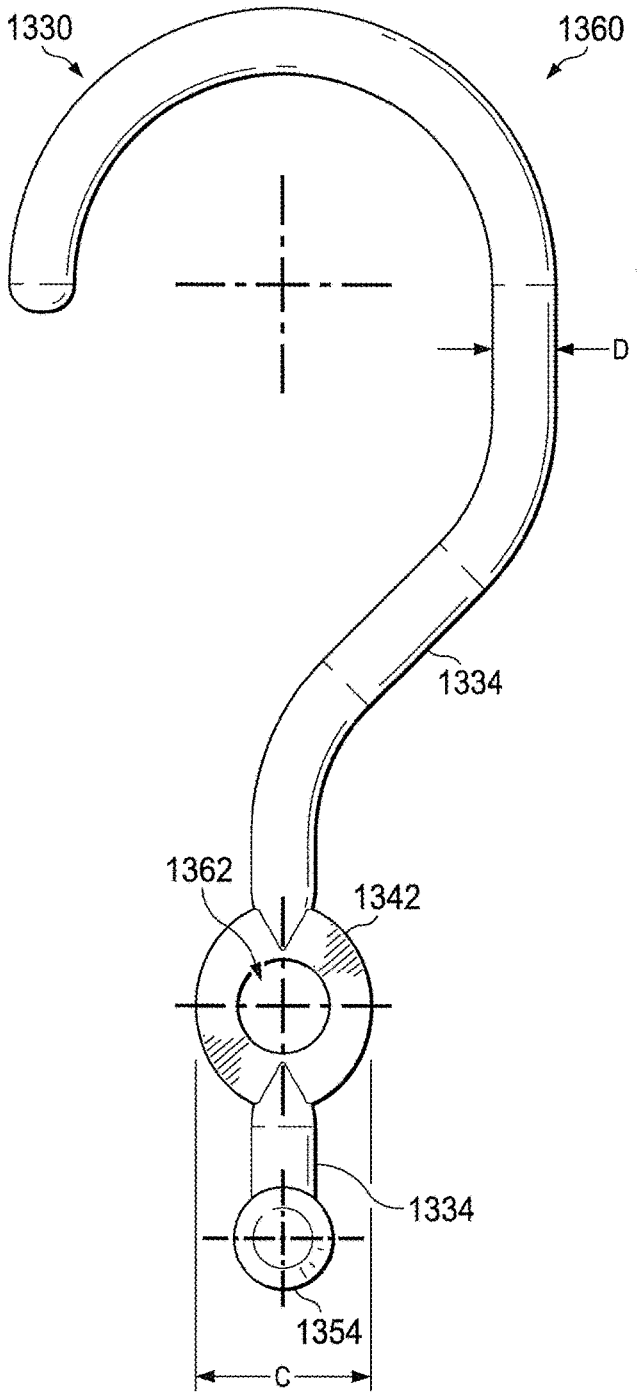

In one specific embodiment, the dimension "B" is approximately 9/32 of an inch and the relevant thickness of the hook unit 1360 (shown in FIGS. 17 and 18 as dimension "D") is approximately 8/32 (1/4) of an inch. In other words, dimension "B" is about 1/32 of an inch greater (or is slightly greater or equal to) than the relevant thickness of the hook unit 1360. The dimension "A" is approximately 21/32 of an inch and the overall width of the eyelet 1342 (shown in FIG. 18 as dimension "D") is approximately 20/32 (5/8) of an inch. In other words, dimension "A" is about 1/32 of an inch greater (or is slightly greater or equal to) than the width of the eyelet 1342. It will be appreciated that various different dimensions and sizes may be utilized consistent with the dimensional relationships described above between dimensions A and C and between dimensions B and D As shown in FIGS. 17 and 18 the accessory aperture or eyelet 1342 is integrated with the neck 1334 and is configured to pass through the aperture 1352 while positioned in at least one radial orientation. For example, the width 1366 (dimension C) of the eyelet 1342, when positioned in a first radial orientation aligned with the aperture 1352 in the aperture housing 1351, is equal to or smaller than dimension "A" allowing the eyelet 1342 to pass through the aperture 1352. In another embodiment, the width 1366 (dimension C) of the eyelet 1342 may be equal to or slightly greater than dimension A of the aperture 1352 allowing the eyelet 1342 to pass therethrough when either one, or both, of the eyelet 1342 and aperture housing 1352 are constructed of material(s) that function to bend or flex (without damaging a material(s) or the shape of the component).

Furthermore, the eyelet 1342 is prevented from passing through the aperture 1352 when positioned in a second radial direction and orientation (e.g., +/−90 degrees from the first radial direction). For example, the width 1366 (dimension C) of the eyelet 1342 is greater than dimension B of the aperture 1352. Thus, when positioned in the second radial orientation aligned with, for example dimension "B" of the aperture 1352, the eyelet 1342 will not pass through the aperture 1352. As will be appreciated, this configuration enables the coupling of the hook 1330 with the garment support structure 1302 in only one of two radial orientations—in which a lateral plane of the garment support structure 1302 is in the same plane as a lateral plane of the hook unit 1360 (see, FIG. 13). Because of this, the garment support structure will pivot in that same plane about the axis or pivot point 1350.

It should be understood that the garment support structure 1302 is a physically separate structure from the hook unit 1360. Thus, the hook unit 1360 may be inserted into and up through the aperture 1352 from the bottom opening of the aperture 1352 and out the top opening of the aperture 1352. Furthermore, the hook unit 1360 may be rotated enabling the eyelet 1342 to align with the aperture 1352 to pass through. Finally, the hook unit 1360 is pulled through the aperture 1352 until the flanged portion 1354 engages with the engaging portion 1356.

In an embodiment, as shown in FIGS. 17 and 18, the eyelet 1342 includes an opening 1362 so that a pin or object (not shown) may be inserted through and secured to the hanger using the eyelet 1342. In one embodiment, the eyelet 1342 has opposing and flat side portions **1343*a* and 1343*b* to provide one or more flat surface(s) for the pin or object to abut against. The flat surfaces are realized by forming the eyelet 1342 with a dimension (dimension "E") that is less than the thickness dimension (dimension D) of hook unit 1360**.

The engaging portion 1356 forming the aperture 1352 is configured to retain the flanged portion 1354 coupled to the lower end of the neck 1334. In various embodiments, the flanged portion 1354 can is configured with a round-shaped cross-section area with respect to the vertical direction, a symmetrical cross-section area with respect to the vertical direction, or an asymmetrical cross-section area with respect to the vertical direction. For example, when the flanged portion 1354 is configured as a round-shaped cross-section area, the cross-sectional dimension (e.g., a diameter) "F" (as shown in FIG. 17) is greater than at least the shortest dimension (e.g., dimension "A" or dimension "B" as shown in FIGS. 15 and 16) of the aperture 1352. Thus, the flanged portion 1354 is unable to pass through the aperture 1352 and is retained by the engaging portion 1356 within the aperture housing 1351. Furthermore, when the flanged portion 1352 is configured as a symmetrical or asymmetrical cross-section area, the cross-section dimensions of the flanged portion 1354 are greater than the longest dimension (e.g. dimension "A" or dimension "B" as shown in FIGS. 15 and 16) of the aperture 1352. Consequently, the flanged portion 1354 is unable to pass through the aperture 1352 and is retained by the engaging portion 1356.

It should be understood that the engaging portion 1356 may be configured to fit with the contour of the flanged portion 1354. In one embodiment, the engaging portion 1356 may be formed with a rigid surface/material so that flanged portion 1354 once engaged with the engaging portion 1356 cannot advance further through the aperture 1352 without damage. The engaging portion 1356 may also include a malleable surface/material which can allow the flanged portion 1354 to advance a distance through the aperture 1352 after engaging with the engaging surface 1356 but without allowing the flanged portion 1354 to penetrate completely through the aperture 1352 thereby decoupling the hook unit 1360 from the garment support structure 1302. The malleable surface/material of the engaging portion 1356 may allow the coupling mechanism 1340 to better retain (e.g., by holding the flanged portion 1354 in a retained position with the engaging portion 1356 with respect the vertical direction, by creating additional friction between the flanged portion 1354 and the engaging portion 1356 in the vertical direction, or the like) engagement between the flanged portion 1354 and the engaging portion 1356.

In an embodiment, the shape of the aperture 1352 is configured such that the hook unit 1360 pivots about the axis 1350 in a horizontal direction (e.g., from the left to right side or vice versa of the page of FIG. 13). As previously discussed, the aperture 1352 has a first dimension (e.g. dimension "A") and a second dimension (e.g. dimension "B"). In one embodiment, the first dimension is substantially greater than the cross-sectional dimension of the hook unit 1360 (e.g., the neck 1334) while the second dimension is slightly greater than the dimension of the hook unit 1360 (e.g., the neck 1334) such that when the flanged portion 1354 is engaged with the engaging portion 1356, the hook unit 1360 can pivot about the axis 1350 (see FIGS. 13 and 14) guided or limited by the lengths of the first and second dimension.

Figure 19A:
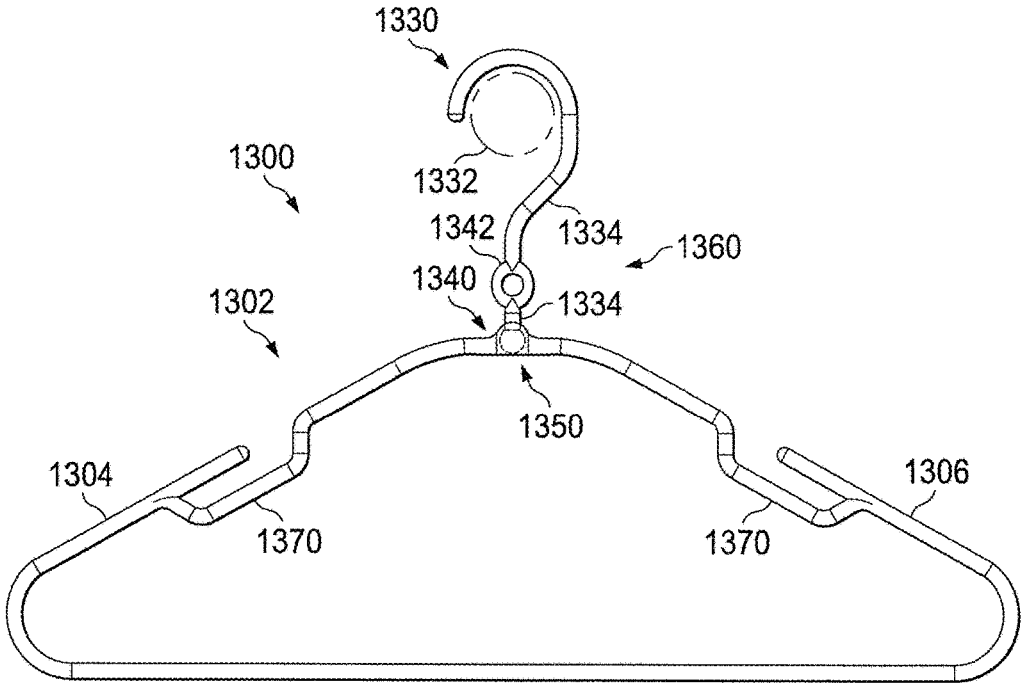
FIGS. 19A and 19B show another embodiment of the garment hanger shown in FIG. 13.
Figure 19B:
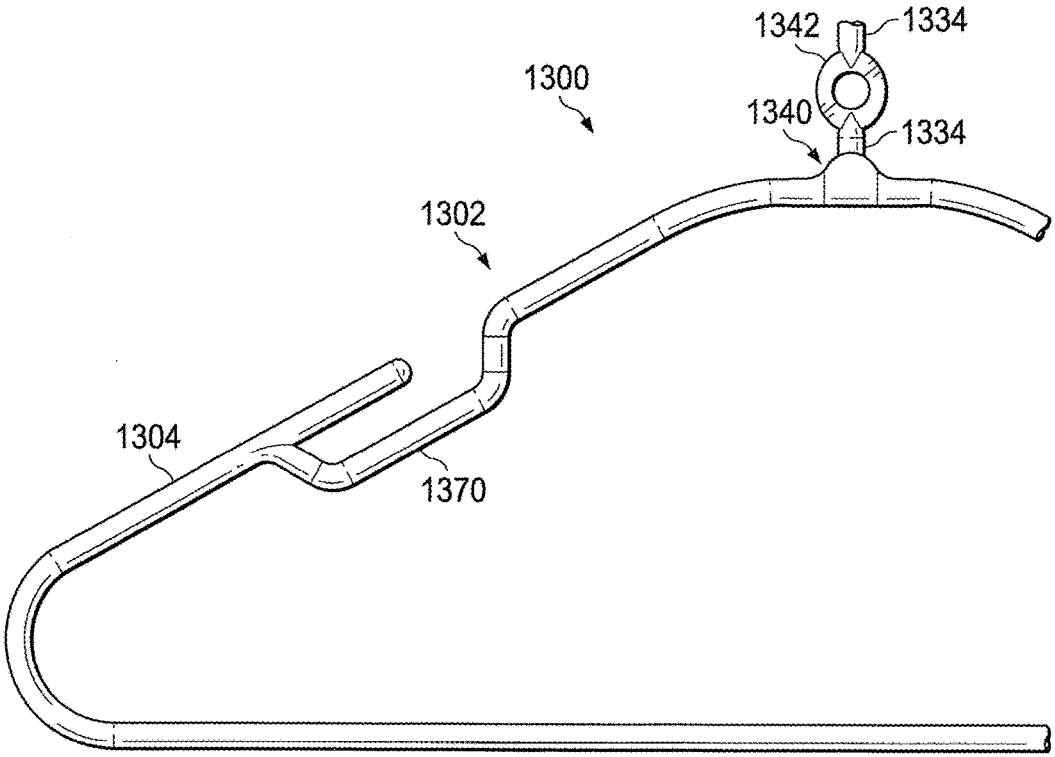

Now turning to FIGS. 19A and 19B, another embodiment of the elongated arms 1304, 1306 are shown. These arms can include a bend 1370 or one or more turns shaped to support straps of a dress, overalls, or the like.

Figure 20A:
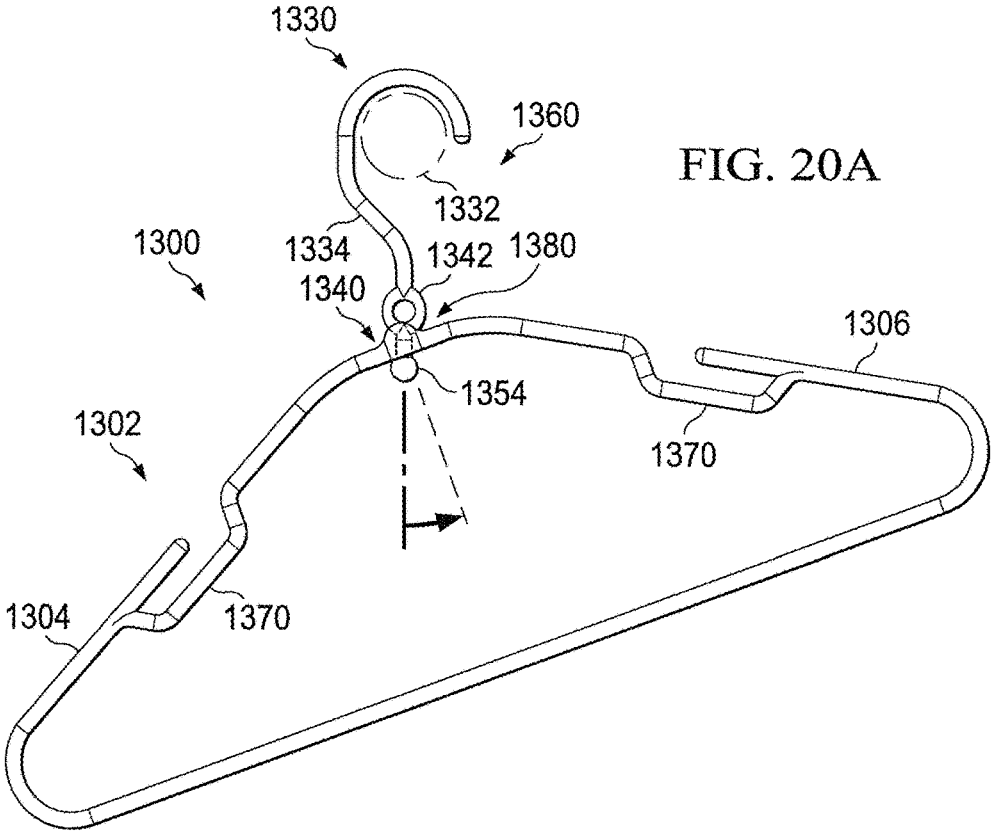
FIGS. 20A and 20B show another embodiment of the garment hanger shown in FIG. 13.
Figure 20B:
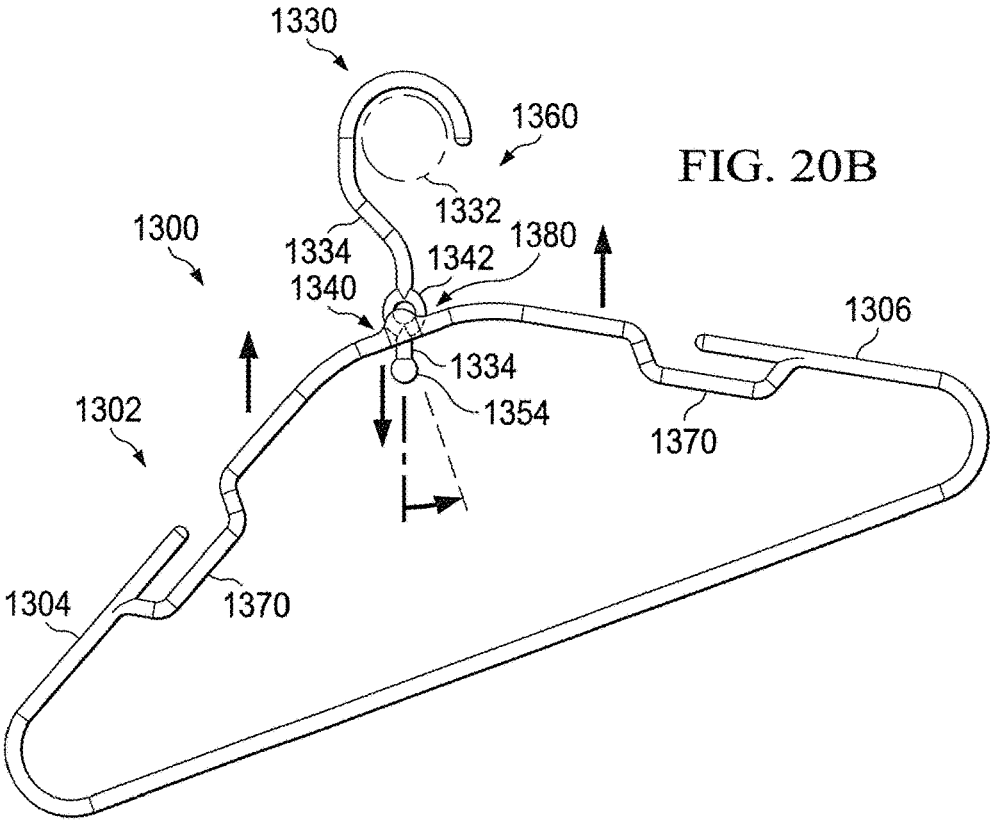

FIGS. 20A and 20B depict embodiments of the hanger 1300 at least similar to the embodiments described herein. The hanger 1330 may also comprise a guiding portion 1380. The guiding portion 1380 is configured to guide or retain the movement of the hook unit 1360 so that the hook unit 1360 pivots in a horizontal direction (e.g., a left and right direction across a page, such as the page depicting FIGS. 13 and 14) while limiting movement in a direction parallel to the axis 1350 (see, again FIGS. 13 and 14).

Each of the hanger embodiments described herein can be constructed of various conventional materials using conventional construction methods. For example, the hook unit 1360 and/or the support structure 1302 may be constructed of molded or preformed plastic with a tubular or rod cross section. In addition, the hanger 100 can be formed using, for example, preformed plastic rodding, plastic extrusions, plastic coated wire, plastic tubing, metal tubing, mixtures thereof or the like, as desired.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A garment hanger comprising:

a garment support structure having first and second elongated arms arranged for supporting the opposed shoulders of a garment;

an aperture disposed at an apex of the garment support structure, the aperture extending through a joint coupling the first elongated arm with the second elongated arm, the joint and aperture integrally formed as part of the garment support structure, and wherein the aperture comprises an A dimension and a B dimension, wherein A and B are different;

a hook unit configured to pass through the aperture and configured for suspending the hanger from a support structure;

an eyelet configured to pass through the aperture while positioned in a first radial orientation and prevented from passing through the aperture while positioned in a second radial orientation, wherein the eyelet comprises a width greater than at least one dimension of the aperture; and a means for removably coupling the hook unit to the garment support structure.

2. The garment hanger of claim 1, wherein the means for coupling the hook unit to the garment support structure comprises enabling both the first and second arms to rotate in substantially a same plane about a generally horizontal pivot axis.

3. The garment hanger of claim 1, wherein the A dimension is substantially larger than the B dimension.

4. The garment hanger of claim 1, wherein the eyelet comprises a width smaller than at least one dimension of the aperture.

5. The garment hanger of claim 1, wherein the eyelet comprises a thickness less than the thickness of the hook unit.

6. The garment hanger of claim 1, wherein the aperture faces in a vertical direction, and the joint and the aperture are integrally formed as part of the garment support structure.

7. The garment hanger of claim 1, wherein the hook unit comprises a flanged portion configure to engage with an engaging portion forming the aperture.

8. The garment hanger of claim 7, wherein the flanged portion comprises a dimension larger than any dimension of the aperture.

9. A method of assembling a garment hanger, the method comprising:

inserting a hook unit comprising a flanged portion through an aperture of a garment support structure, wherein the garment support structure comprises first and second elongated arms arranged for supporting the opposed shoulders of a garment, and wherein the aperture is disposed at the apex of the garment support structure and extends through a joint coupling the first elongated arm with the second elongated arm, and wherein the aperture comprises an A dimension and a B dimension, wherein A and B are different, and wherein the hook unit further comprises an eyelet;

communicating the hook unit through the aperture; and coupling the hook unit with the garment support structure so that the hook unit is configured to pivot about an axis.

10. The method of claim 9, wherein communicating the hook unit through the aperture comprises rotating the hook unit into a first position so that the eyelet is able to pass through the aperture.

11. The method of claim 10, wherein coupling the hook unit with the garment support structure comprises rotating the hook unit into a second position after the eyelet passes through the aperture so that the eyelet is prevented from passing through the aperture.

12. The method of claim 11, wherein rotating the hook unit into the first position comprises aligning the eyelet with a dimension of the aperture larger than the width of the eyelet.

13. The method of claim 11, wherein rotating the hook unit into the second position comprises aligning the eyelet with a dimension of the aperture smaller than the width of the eyelet.

14. The method of claim 10, wherein the A dimension is substantially larger than the B dimension.

15. The method of claim 10, further comprising engaging the flanged portion with an engaging portion of the garment support structure after passing the hook unit through the aperture, wherein the engaging portion forms the aperture.

16. The method of claim 14, wherein the flanged portion comprises a dimension greater than the largest dimension of the aperture.

17. The method of claim 10, wherein the eyelet comprises a thickness less than the thickness of the hook unit.

18. The method of claim 10, wherein the aperture faces in a vertical direction.

* * * * *